US006733360B2

(12) United States Patent
Dooley et al.

(10) Patent No.: US 6,733,360 B2
(45) Date of Patent: May 11, 2004

(54) TOY DEVICE RESPONSIVE TO VISUAL INPUT

(75) Inventors: Mike Dooley, San Rafael, CA (US); Soren Lund, San Rafael, CA (US); Guy Nicholas, Santa Rosa, CA (US); Allan Young, Santa Rosa, CA (US)

(73) Assignee: Interlego AG, Barr (CH)

( * ) Notice: Subject to any disclaimer, the term of this patent is extended or adjusted under 35 U.S.C. 154(b) by 379 days.

(21) Appl. No.: 09/776,280

(22) Filed: Feb. 2, 2001

(65) Prior Publication Data

US 2002/0106965 A1 Aug. 8, 2002

(51) Int. Cl.[7] ..... A63H 36/00
(52) U.S. Cl. ..... 446/454
(58) Field of Search ..... 446/175, 444–446, 446/454; 463/48; 901/1, 46, 47

(56) References Cited

U.S. PATENT DOCUMENTS 4,729,563 A * 3/1988 Yokoi ..... 463/31
4,894,040 A * 1/1990 Bach et al. ..... 446/91
5,267,863 A * 12/1993 Simmons, Jr. ..... 434/96
5,723,855 A * 3/1998 Oh et al. ..... 250/206.1
6,167,353 A * 12/2000 Piernot et al. ..... 702/94
6,362,589 B1 * 3/2002 Inoue ..... 318/568.2
6,482,064 B1 * 11/2002 Lund ..... 446/175

FOREIGN PATENT DOCUMENTS

| | | | |
|---|---|---|---|
| EP | 1176572 | * | 1/2002 |
| JP | 01112490 | * | 5/1989 |
| JP | 07-112077 | * | 5/1995 |
| WO | WO 00/44465 | * | 8/2000 |
| WO | WO 00/45924 | * | 10/2002 |

* cited by examiner

*Primary Examiner*—John M. Hotaling, II
(74) *Attorney, Agent, or Firm*—Pitney, Hardin, Kipp & Szuch LLP

(57) ABSTRACT

The system includes a digital camera or similar CCD or CMOS device which transmits image data to a computing device. Changes such as motion, light or color are detected in various sectors or regions of the image. These changes are evaluated by software which generates output to an audio speaker and/or to an infra-red, radio frequency, or similar transmitter. The transmitter forms a link to a microprocessor based platform which includes remote microprocessor software. Additionally, the platform include mechanical connections upon which a robot can be built and into which the digital camera can be incorporated.

7 Claims, 4 Drawing Sheets

TOY DEVICE RESPONSIVE TO VISUAL INPUT

BACKGROUND OF THE INVENTION

1. Field of the Invention

This invention pertains to a toy device which is responsive to visual input, particularly visual input in different sectors of the visual field.

2. Description of the Prior Art

In the prior art, simplified robot-type toys for children are known. However, these robot-type toys typically have a pre-set number of activities. While these robot-type toys have been satisfactory in many ways, they typically have not capitalized on the child's interest in order to provide an avenue to elementary computer programming.

While some electronic kits have been produced to allow the consumer to build a robot-type toy, these electronic kits have tended to be complicated and required an adult level of skill to operate.

OBJECTS AND SUMMARY OF THE INVENTION

It is therefore an object of the present invention to provide a toy device which has a wide range of activities.

It is therefore a further object of the present invention to provide a toy device which can maintain the sustained interest of children.

It is therefore a still further object of the present invention to provide a toy device which can be programmed by a child.

It is therefore a still further object of the present invention to provide a toy device which can be assembled by a child.

These and other objects are attained by providing a system with a microprocessor-based platform. The microprocessor-based platform typically can receive wheels which it can control and further provides the physical platform upon which the robot can be built using elements which include interlocking building blocks which are physically and visually familiar to children. The microprocessor-based unit receives commands via a link, such as an infrared link or a radio frequency link, from a personal computer. The personal computer receives input from a digital camera or similar visual sensor. The digital camera or similar visual sensor includes interlocking elements to allow it to be incorporated into the robot built from the interlocking building blocks. The personal computer receives the input from the digital camera and, via a program implemented in software, processes the visual input, taking into account various changes (motion, light, pattern recognition or color) in the various sectors of the visual field, and sends commands to the microprocessor-based platform. The program is implemented modularly within software to allow children to re-configure the program to provide various responses of the robot-type toy to various visual inputs to the digital camera. These various programmed responses provide for a wide range of activities possible by the robot-type toy.

Moreover, the system can be configured without the microprocessor-based unit so that the personal computer is responsive to changes in the sectors of the visual field as detected by the digital camera, with processing. There are many possibilities for such a configuration. One configuration, for example, is that the personal computer would drive audio speakers in response to physical movements of the user in the various sectors of the visual field as sensed by the digital camera. This could result in a virtual keyboard, with sounds generated in response to the movements of the user.

Alternately, an auxiliary device may be activated in response to a movement in the visual field, pattern recognition or a particular color entering or exiting the field. The auxiliary device could be a motor which receives instructions to follow a red ball, or a light switch which receives instructions to switch on when any movement is sensed.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
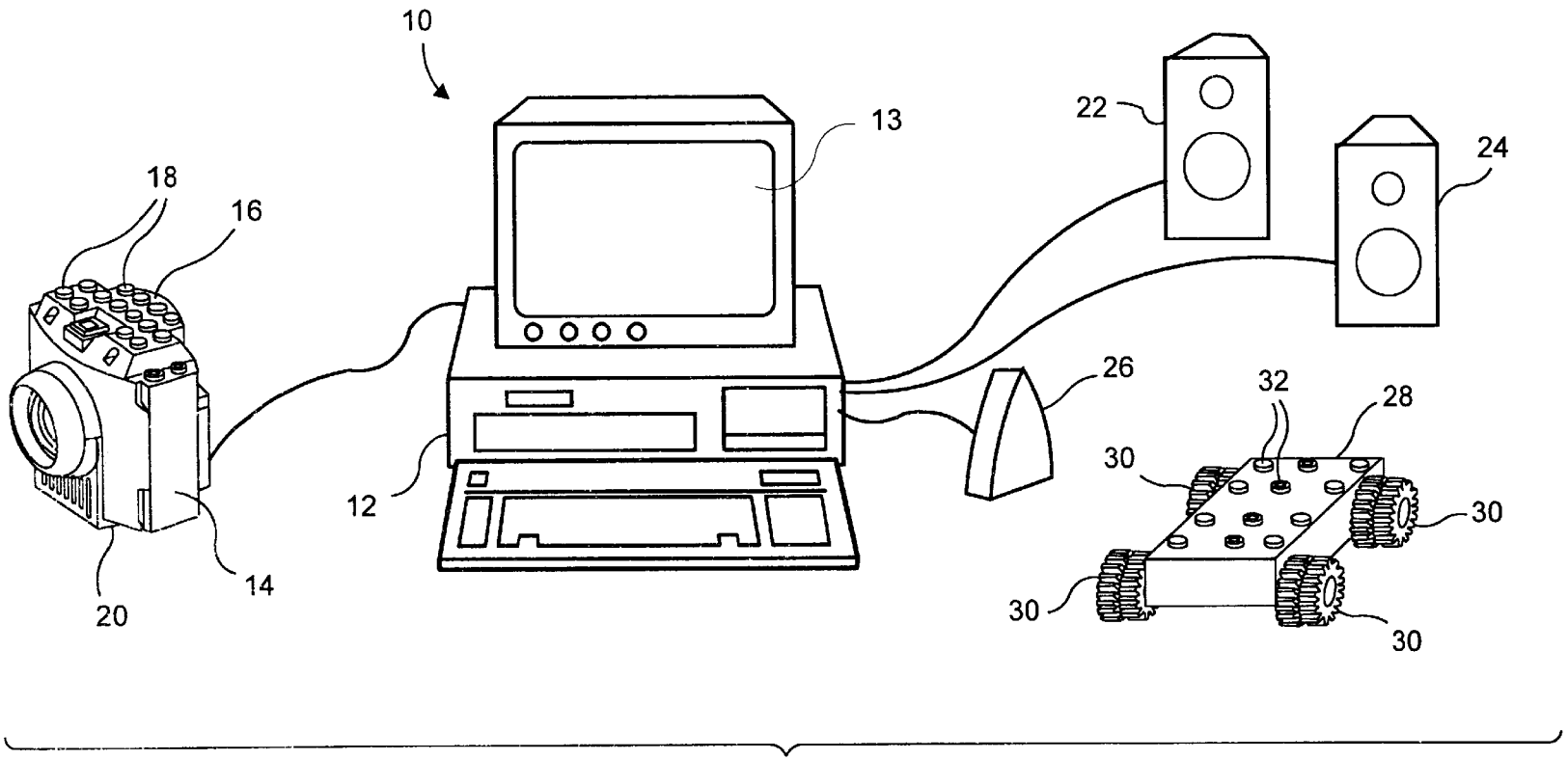
FIG. 1 is a perspective view of a schematic of the present invention, showing the personal computer and the various components, and the digital camera separate from the microprocessor-based platform.
Figure 2:
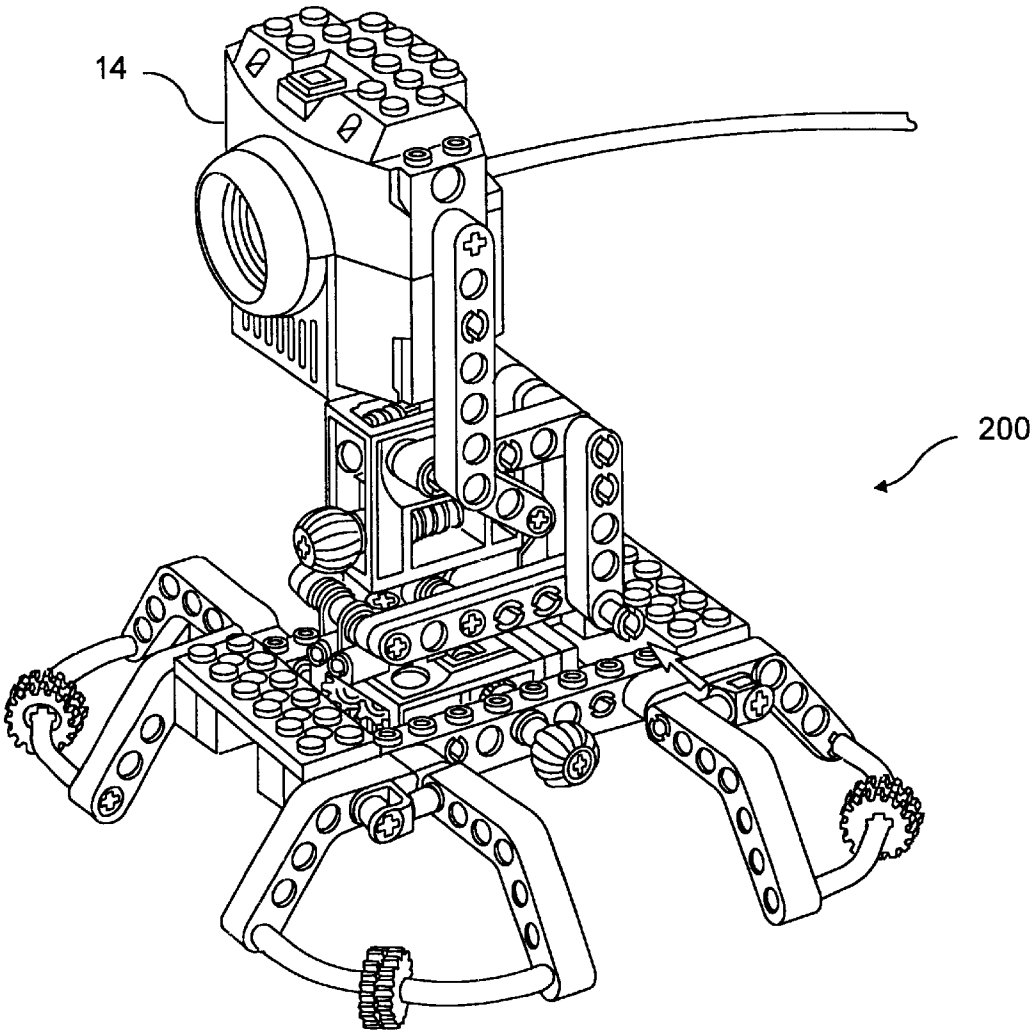
FIG. 2 is a perspective view of the robot-type toy of the present invention, built upon a microprocessor-based platform.
Figure 4:
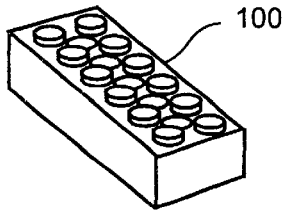
FIG. 4 is a perspective view of the building blocks typically used in the construction of the robot-type toy of the present invention.

Referring now to the drawings in detail wherein like numerals indicate like elements throughout the several views, one sees that FIG. 1 is a perspective view of a schematic of the system 10 of the present invention. Personal computer 12 (the term "personal computer" is to be interpreted broadly to include any number of computers for personal or home use, including devices dedicated to "game" applications as well as even hand-held devices), including screen 13, receives input from a digital camera 14 (which is defined broadly but may be a PC digital video camera using CCD or CMOS technology) via a USB (universal serial bus) or similar port such as a parallel port. The upper surface 16 of digital camera 14 includes frictional engaging cylinders 18 while the lower surface 20 of digital camera 14 includes complementary frictional engaging apertures (not shown) and frictional engaging wall (not shown) so as to create a building element compatible with the building block 100 shown in FIG. 4 and the building blocks shown in FIG. 2 to build robot 200.

As further shown in FIG. 1, the software of personal computer 12, responsive to the input from digital camera 14, determines the output of personal computer 12 to an auxiliary device such as audio speakers 22, 24 via a sound card or other interface known to those in the prior art. Personal computer 12 typically includes standard operating system software, and further includes, as part of the present invention, vision evaluation software and additional robotics software (the robotics software is downloaded, at least in part, from personal computer 12 to microprocessor-based platform 28 via infra-red, radio-frequency or similar transmitter 26), the functions of which will be described in more detail hereinafter. In one configuration, musical notes can be generated through audio speakers in accordance with the movements of a user or other visual phenomena in the various sectors of the visual field as detected by digital camera 14. In another configuration, an auxiliary device may be activated in response to a movement in the visual field or a particular color entering or exiting the field. The auxiliary device could be a motor which receives instructions to follow a particular color ball, or a light switch which receives instructions to turn on in response to particular visual phenomena.

Furthermore, the personal computer 12 drives infra-red, radio-frequency or similar transmitter 26 in accordance with visual phenomena as detected by digital camera 14. The signals from transmitter 26 are detected by a detector in microprocessor-based platform 28. This typically results in a master/slave relationship between the personal computer 12 (master) and the microprocessor-based platform 28 (slave) in that the personal computer 12 initiates all communication and the microprocessor-based platform 28 responds. The microprocessor-based platform 28 typically does not query the personal computer 12 to find out a particular state of digital camera 14. Wheels 30 can be attached to and controlled by microprocessor-based platform 28. Wheels 30 include internal motors (not shown) which can receive instructions to drive and steer platform 28 based on commands as received from transmitter 26 by the microprocessor in platform 28. Furthermore, upper surface 32 of microprocessor-based platform includes frictional engaging cylinders 34 similar to cylinders 18 found on the upper surface 16 of digital camera 14 and likewise similar to those found on the upper surface of building block 100 shown on FIG. 4. This allows a robot or similar structure to be built on microprocessor-based platform using building blocks 100 and digital camera 14. An alternative immobile structure is disclosed in FIG. 2. Indeed, this provides the structure for a robot to be responsive to the visual phenomena, such as motion, light and color, in the various sectors of the visual field as detected by a camera incorporated into the robot itself. The responses of the robot to visual phenomena can include the movement of the physical location of the robot itself, by controlling the steering and movement of wheels 30. Further responses include movement of the various appendages of the robot. Moreover, the same feedback loop which is established for visual phenomena can be extended to auditory or other phenomena with the appropriate sensors.

It is envisioned that there will be at least three modes of operation of system 10—the camera only mode, the standard mode and the advanced or "pro" mode.

In the camera only mode, the microprocessor-based platform 28 is omitted and the personal computer 12 is responsive to the digital camera 14. This mode can be used to train the user in the modular programming and responses of personal computer 12. An example would be to play a sound from audio speakers 22, 24 when there is motion in a given sector of the visual field. This would allow the user to configure a virtual keyboard within the air, wherein hand movements to a particular sector of the visual field would result in the sounding of a particular note. Other possible actions include taking a still picture (i.e., a "snapshot") or making a video recording.

In the standard mode, the infra-red transmitter 26 and microprocessor-controlled platform 28 are involved in addition to the components used in the camera only mode. By using the personal computer 12, the user programs commands for the microprocessor-controlled platform 28 to link with events from digital camera 14. All programming in this mode is done within the vision evaluation portion of the software of the personal computer 12. The drivers of the additional robotics software are used, but otherwise, the additional robotics software is not typically used in this mode. Furthermore, typically digital camera 14 is envisioned to be the only sensor to be supported in the standard mode, although other sensors could be supported in some embodiments.

The standard mode includes the features of the "camera only" mode and further includes additional features. In the standard mode, the user will be programming the personal computer 12. Typically, however, in order to provide a mode with reduced complexity, it is envisioned that the programming in the standard mode will not include "if-then" branches or nested loops, although these operations could be supported in some embodiments.

The processor intensive tasks, such as video processing and recognition based on input from digital camera 14, are handled by the personal computer 12. Commands based on these calculation are transmitted to the microprocessor-based platform 28 via transmitter 26.

The user interface in the standard mode is typically the same as the interface in the "camera only" mode, but the user is presented with more modules with which to program. In order to program within the standard mode, the user is presented with a "camera view screen" on the screen 13 of the personal computer 12. This shows the live feed from digital camera 14 on the screen 13 of personal computer 12. The view screen will typically be shown with a template over it which divides the screen into different sectors or regions. By doing this, each sector or region is treated as a simple event monitor. For instance, a simple template would divide the screen into four quadrants. If something happens in a quadrant, the event is linked to a response by the microprocessor-based platform 28, as well as the personal computer 12 and or the digital camera 14. The vision evaluation software would allow the user to select between different pre-stored grids, each of which would follow a different pattern. It is envisioned that the user could select from at least twenty different grids. Moreover, it is envisioned that, in some embodiments, the user may be provided with a map editor to create a custom grid.

Figure 3:
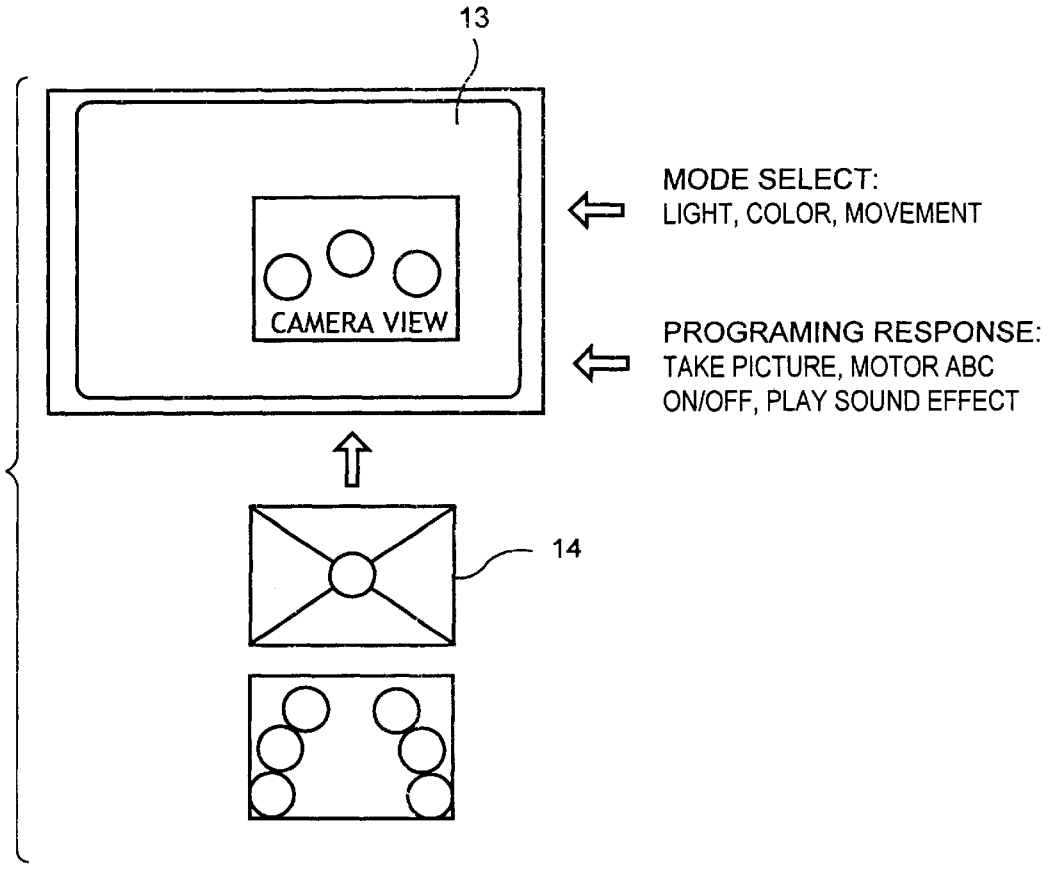
FIG. 3 is a schematic of the various inputs which determine the display on the screen of the personal computer and the output when used with the system of the present invention.

Each portion of the grid (such as a quadrant or other sector) can be envisioned as a "button" which can be programmed to be triggered by some defined event or change in state. For example, such visual phenomena from digital camera 14 could include motion (that is, change in pixels), change in light level, pattern recognition or change in color. In order to keep things simple in the standard mode, the user might select a single "sensor mode" at a time for the entire view screen rather than the option with each region having its own setting. However, the specific action chosen in response to the detected motion would be dependent upon the quadrant or sector of the grid in which the motion or change was detected. This is illustrated in FIG. 3 in that the input to personal computer 12 includes the mode select (that is, responsive to light, color or movement), the selected programming response to the detected change (for example, take a picture, turn on 'or off' a specific motor in the robot thereby effecting a specific robot movement or position, or play a specific sound effect), and the visual input from digital camera 14.

Each sector can have a single stack of commands that are activated in sequence when the specified event is detected. The individual commands within the stack can include personal computer commands (such as play a sound effect, play a sound file or show an animation effect on screen 13);

a camera command (implemented via the personal computer 12 and including such commands as "take a picture", "record a video" or "record a sound"); and microprocessor-based platform commands via infra-red transmitter 26 (such as sound and motor commands or impact variables).

The microprocessor-based platform commands can include panning left or right on a first motor of a turntable subassembly, tilting up or down on a second motor of a turntable subassembly, forward or backward for a rover subassembly, spin left or right for a rover subassembly (typically implemented by running two motors in opposite directions); general motor control (such as editing on/off or directions for the various motors of either the turntable subassembly or the rover subassembly); and a wait command for a given period of time within a possible range.

In the advanced or "pro" mode, many of the simplifications of the standard mode can be modified or discarded. Most importantly, the advanced or "pro" mode provides a richer programming environment for the user. That is, more command blocks are available to the user and more sensors, such as touch (i.e., detecting a bump), sound, light, temperature and rotation, are available. This mode allows the user to program the microprocessor-based platform 28 to react to vision evaluation events while at the same time running a full remote microprocessor program featuring all the available commands, control structure and standard sensor input based events. This works only with the robotics software and requires the user to have the vision evaluation software as well as access to the vision evaluation functions within the remote microprocessor code. The envisioned design is that the robotics software will include all the code required for running in the "pro" mode rather than requiring any call from the remote microprocessor code to the stand-alone vision evaluation software.

The remote microprocessor code in the robotics software will be supplied with vision evaluation software blocks for sensor watchers and stack controllers. These are envisioned to be visible but "gray out" if the user does not have the vision control software installed.

Once the vision control software is installed, the commands within the remote microprocessor code become available and work like other sensor-based commands. For instance, a user can add a camera sensor watcher to monitor for a camera event. Alternately, a "repeat-until" instruction can be implemented which depends upon a condition being sensed by digital camera 14.

When a user has a vision evaluation software instruction into the remote microprocessor code, a video window will launch on screen 13 when the run button is pressed in remote microprocessor code. It will appear to the user that the robotics software is loading a module from the vision evaluation software. However, the robotics software is running its own vision control module as the two applications never run at the same time. The only connections envisioned are that the robotics software checks the vision evaluation software in order to unlock the vision control commands within the remote microprocessor code, and if there is a problem with the digital camera 14 within the remote microprocessor code, the robotics software will instruct the user to run the troubleshooting software in the vision evaluation software for the digital camera 14.

Once the module is running the video window will show a grid and a mode, taken directly from the vision evaluation software design and code base. The grid and mode will be determined based on the vision evaluation software command the user first put into the remote microprocessor code program. The video window will run until the user presses "stop" on the interface, or until a pre-set time-out occurs or an end-of-program block is reached.

While running in the advanced or "pro" mode, the personal computer 12 will monitor for visual events based on the grid and sending mode and continually transmit data via the infra-red transmitter 26 to microprocessor-based platform 28 (which, of course, contains the remote microprocessor software). This transmission could be selected to be in one of many different formats, as would be known to one skilled in the art, however, PB-message and set variable direct command are envisioned. In particular, the set variable direct command format would allow the personal computer 12 to send a data array that the remote microprocessor software could read from, such as assigning one bit to each area of a grid so that the remote microprocessor software could, in effect, monitor multiple states. This wold allow the remote microprocessor software to evaluate the visual data on a more precise level. For instance, yes/no branches could be used to ask "is there yellow in area 2", and, if so, "is there yellow in area 6 as well". This approach allows the remote microprocessor software to perform rich behaviors, like trying to pinpoint the location of a yellow ball and drive toward it.

Regardless of the data type chosen, it would be transparent to the user. The user would just need to know what type of mode to put the digital camera in and which grid areas or sectors to check.

The remote microprocessor chip (that is, the microprocessor in microprocessor-based platform 28) performs substantially all of the decision making in the advanced or "pro" mode. Using access control regions and event monitors, the remote microprocessor software will control how and when it responds to communications from personal computer 12 (again, "personal computer" is defined very broadly to include compatible computing devices). This feature is important as the user does not have to address issues of timing and coordination that can occur in the background in the standard mode. Additionally, the user can add other sensors. For instance, the user can have a touch sensor event next to a camera event, so that the robot will look for the ball but still avoid obstacles with its feelers. This type of programming works only with access control turned on, particularly when the camera is put into the motion sensing mode.

Figure 5:
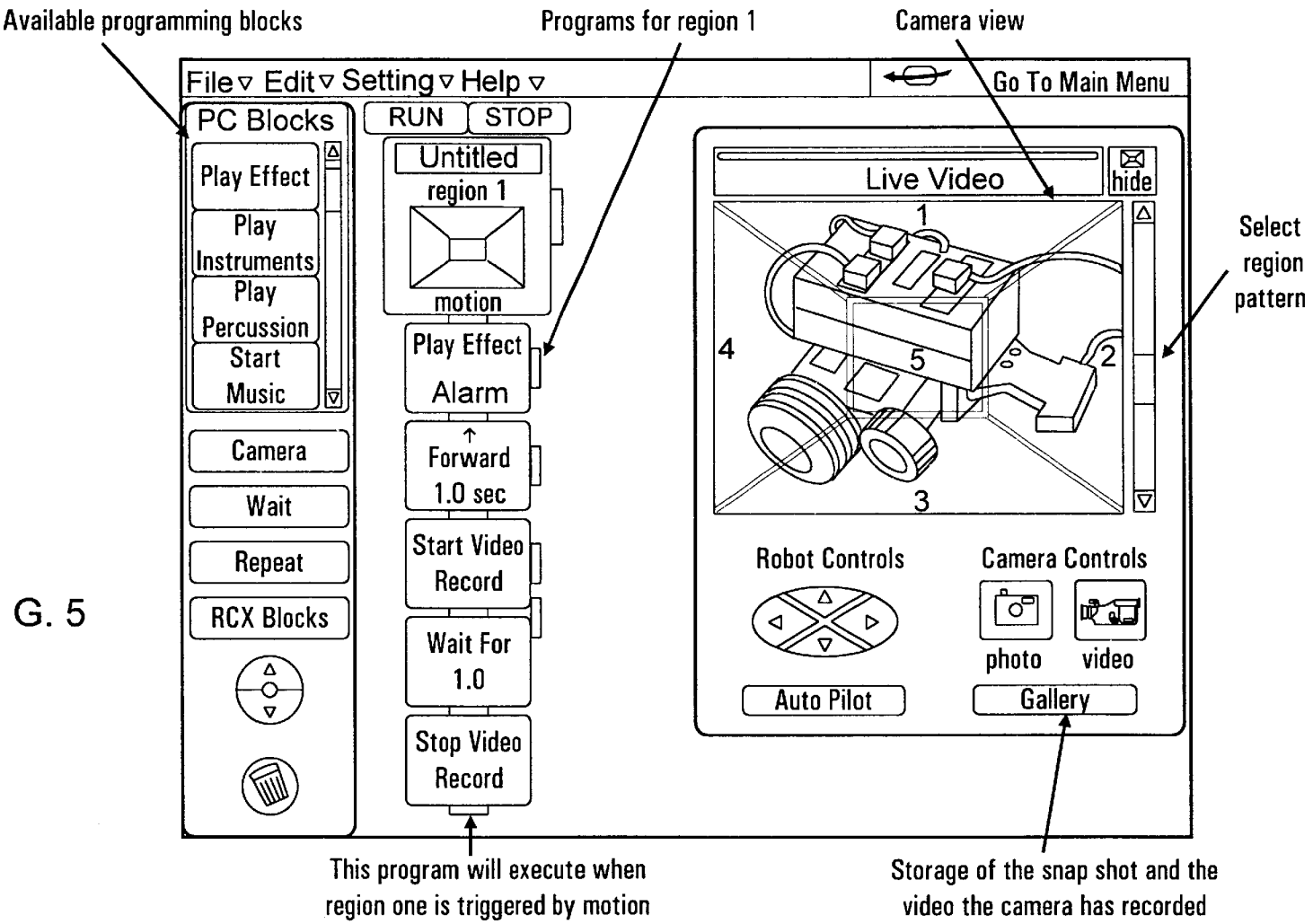
FIG. 5 is a sample screen of the personal computer during assembly and/or operation of the robot-type toy of the present invention.

FIG. 5 shows a typical screen 13 including the available programming blocks, the program for a particular region, the camera view and the various controls.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A vision responsive toy system comprising:

a video camera;

a screen for displaying an image captured by said camera;

a program for detecting a change in a mode of said displayed image and generating a command signal in response to said change in detected mode;

means for selecting a mode;

a template superimposed over said screen and dividing said screen into regions wherein said program detects a change in a mode of an image in a selected one of said regions a unit responsive to said generated command signal; and means for selecting a response of said unit to said generated command signal.

2. The system of claim 1 further comprising means for selecting between a plurality of modes to be detected.

3. The system of claim 1 further comprising means for setting a threshold above which said change in the detected mode must be detected before said command signal is generated.

4. The system of claim 1 wherein the mode selected is one of motion, light level, pattern recognition or color.

5. The system of claim 1 wherein mode change is detected by a change in pixels of said displayed image.

6. The system of claim 1 wherein said video camera is connected to a computing device and said program is run on said computing device.

7. The system of claim 1 wherein said selected one of said regions is the region in which said change is first detected.

* * * * *